US009999285B2

(12) United States Patent
Feng

(10) Patent No.: US 9,999,285 B2
(45) Date of Patent: Jun. 19, 2018

(54) ALUMINUM TUBE-COATED NOVEL HAIR CURLER

(71) Applicant: Shenzhen Lady Merry Technology Co., Ltd., Shenzhen (CN)

(72) Inventor: Ye Feng, Shenzhen (CN)

(73) Assignee: Shenzhen Lady Merry Technology Co., Ltd., Shenzhen (CN)

( * ) Notice: Subject to any disclaimer, the term of this patent is extended or adjusted under 35 U.S.C. 154(b) by 171 days.

(21) Appl. No.: 15/263,095

(22) Filed: Sep. 12, 2016

(65) Prior Publication Data

US 2018/0070694 A1 Mar. 15, 2018

(51) Int. Cl.

| | |
|---|---|
| ***A45D 1/04*** | (2006.01) |
| ***H05B 3/44*** | (2006.01) |
| *A45D 1/00* | (2006.01) |

(52) U.S. Cl.

CPC ..... *A45D 1/04* (2013.01); *H05B 3/44* (2013.01); *A45D 2001/004* (2013.01)

(58) Field of Classification Search

CPC ... A45D 1/04; A45D 1/00; A45D 1/06; A45D 1/10; A45D 1/20; A45D 1/28; A45D 2001/004; A45D 2/001; H05B 3/44; H05B 3/40; H05B 3/42; H05B 3/50

See application file for complete search history.

(56) References Cited

U.S. PATENT DOCUMENTS

2016/0367001 A1* 12/2016 Wang ..... A45D 1/04
2018/0055176 A1* 3/2018 Wong ..... A45D 1/04

* cited by examiner

*Primary Examiner* — Shawntina Fuqua
(74) *Attorney, Agent, or Firm* — Schmeiser, Olsen & Watts, LLP

(57) ABSTRACT

Disclosed is fabric taped aluminum tubes novel hair curler, relating to hairdressing apparatus field. Two ends of upper aluminum tube and lower aluminum tube are clamped onto connector and front stopper support; upper elastic sheet, upper iron sheet and first MCH are arranged inside upper aluminum tube with upper fabric outside; clamping sheet, with one end fixedly connected with lower other side of handle key via screws, is arranged on outer surface of upper fabric; FUSE, silicon gel stopper, lower elastic sheet, lower iron sheet and second MCH are arranged inside lower aluminum tube with lower fabric outside; front stopper is fixedly connected with one end of front stopper support via screws. Special fabrics coated on two semicircular aluminum tubes can generate negative ions, lock moisture and prevent moisture loss, thereby well protecting hair softer; the antistatic, silk-like curler is simple and convenient in operation and more comfortable.

4 Claims, 5 Drawing Sheets

ALUMINUM TUBE-COATED NOVEL HAIR CURLER

FIELD OF THE INVENTION

The present invention relates to an fabric taped aluminum tubes novel hair curler, belonging to the technical field of hairdressing apparatuses.

BACKGROUND OF THE INVENTION

Nowadays, beauty becomes a pursuit, beautiful hair can better show personal beauty, then hairdressing apparatuses are indispensable, which generally include hair straighteners and hair curlers, wherein the hair curler is a handheld electronic product for curling hair and is mainly composed of a handle and a heating drum, the hair curler adopts a circuit panel to control the temperature, and the heating drum made of a tourmaline ceramic panel can averagely disperse heat to realize cyclic heating, improve the protein structure of hair to form curl and protect hair during curling.

At present, the aluminum tubes of the existing hair curlers generally adopt a hardware oil injection or electroplating process. However, when the two processes are used, hair cannot be well protected to be softer, and hair is easy to damage. Moreover, the existing aluminum tubes are circular straight-through tubes, and such structural design is unreasonable and cannot meet the use requirements of people.

SUMMARY OF THE INVENTION

Aiming at the above problems, the technical problem to be solved by the present invention is to provide an fabric taped aluminum tubes novel hair curler.

The fabric taped aluminum tubes novel hair curler of the present invention includes a lower handle, a PCBA (Printed Circuit Board Assembly) plate, a lamp cover, keys, an upper handle, a turning tail, a support cover, a support frame, a handle key, a double-torsion spring, a shaft sleeve, an iron shaft, a connector, a front stopper support, decorative strips, an upper aluminum tube, a lower aluminum tube, an upper elastic sheet, an upper iron sheet, a first MCH (Metal Ceramics Heater), an upper fabric, a clamping sheet, a FUSE, a lower elastic sheet, a lower iron sheet, a second MCH, a lower fabric, a front stopper, a power wire and a silica gel stopper, wherein the PCBA plate is arranged in the lower handle and fixed in the lower handle via a plurality of screws, the lamp cover and the keys are installed on the PCBA plate, the lower handle is fixedly connected with the upper handle via a plurality of screws, the turning tail is screwed into one end of the lower handle, the other end of the lower handle is fixedly connected with the support cover, the support cover is fixedly connected with the support frame, the handle key is arranged on the support cover, and one side of the lower part of the handle key is fixedly connected with the upper parts of the support cover and the support frame via the double-torsion spring, the shaft sleeve and the iron shaft; one end of the connector is fixedly connected with the support frame, a plurality of decorative strips are connected between the other end of the connector and one end of the front stopper support, the upper aluminum tube and the lower aluminum tube are arranged between the connector and the front stopper support, two ends of the upper aluminum tube and the lower aluminum tube are clamped onto the connector and the front stopper support respectively, and the upper elastic sheet, the upper iron sheet and the first MCH are arranged inside the upper aluminum tube; the upper fabric is arranged outside the upper aluminum tube, the clamping sheet is arranged on the outer surface of the upper fabric, one end of the clamping sheet is fixedly connected with the other side of the lower part of the handle key via a plurality of screws, and the FUSE, the silicon gel stopper, the lower elastic sheet, the lower iron sheet and the second MCH are arranged inside the lower aluminum tube; the lower fabric is arranged outside the lower aluminum tube, the front stopper is fixedly connected with one end of the front stopper support via a plurality of screws, and one end of the power wire is screwed with the turning tail.

Preferably, a decorative part is arranged on the upper handle.

Preferably, both of the upper aluminum tube and the lower aluminum tube are semicircular or in other shapes manufactured according to the demands of users.

Preferably, both of the upper fabric and the lower fabric are made of a mixture of silicon gel and polytetrafluoroethylene.

The fabric taped aluminum tubes novel hair curler has the advantages that the hair curler is reasonable in structural design, simple in installation and convenient to use; each of the adopted two semicircular aluminum tubes is coated with a fabric, and the fabrics made of a special material can generate negative ions, lock moisture and prevent moisture loss, so that hair can be well protected and is softer; the hair curler has an antistatic function, and its surface is as smooth as silk, so that the hair curler is simple and convenient in operation and more comfortable when the hair curler is in use and meets the use requirements of people.

BRIEF DESCRIPTION OF THE DRAWINGS

In order to facilitate illustration, the present invention will be described in detail in combination with the following specific embodiment and accompanying drawings.

1—lower handle; 2—PCBA plate; 3—lamp cover; 4—key; 5—upper handle; 5-1—decorative part; 6—turning tail; 7—support cover; 8—support frame; 9—handle key; 10—double-torsion spring; 11—shaft sleeve; 12—iron shaft; 13—connector; 14—front stopper support; 15—decorative strip; 16—upper aluminum tube; 17—lower aluminum tube; 18—upper elastic sheet; 19—upper iron sheet; 20—first MCH; 21—upper fabric; 22—clamping sheet; 23—FUSE; 24—lower elastic sheet; 25—lower iron sheet; 26—second MCH; 27—lower fabric; 28—front stopper; 29—power wire and 30—silica gel stopper.

DETAILED DESCRIPTION OF THE EMBODIMENTS

Figure 1:
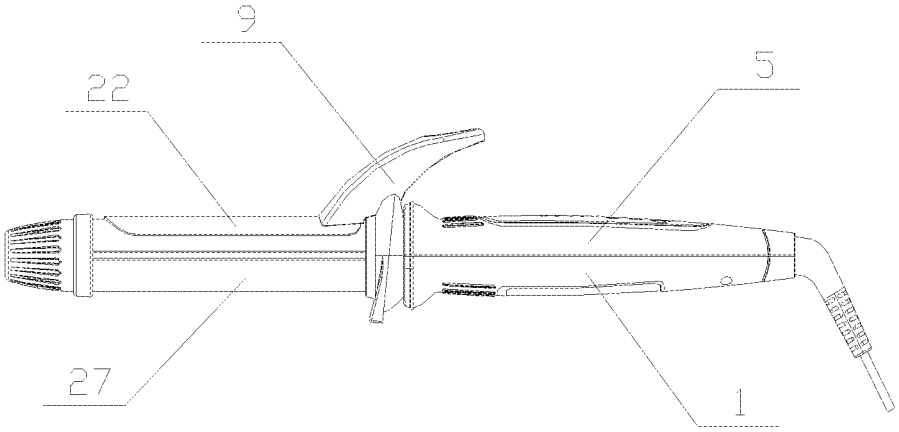
FIG. 1 is a structural schematic diagram of the present invention.
Figure 2:
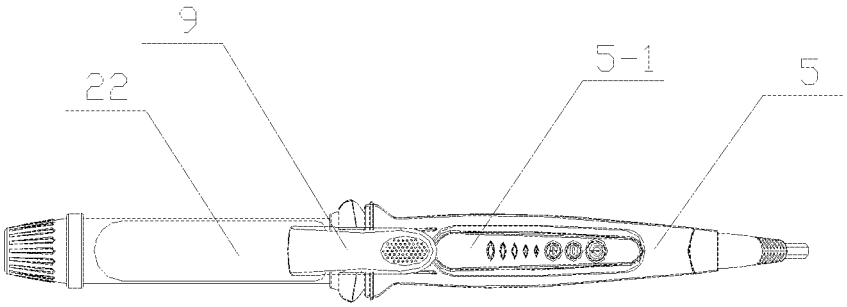
FIG. 2 is a top view of FIG. 1.
Figure 3:
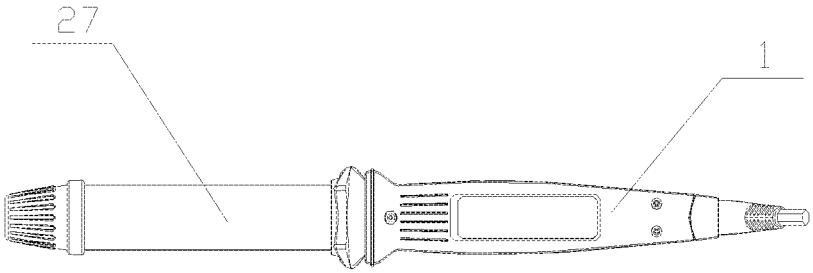
FIG. 3 is a bottom view of FIG. 1.
Figure 4:
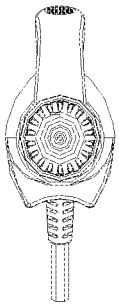
FIG. 4 is a left view of FIG. 1.
Figure 5:
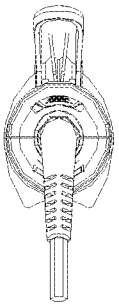
FIG. 5 is a right view of FIG. 1.
Figure 6:
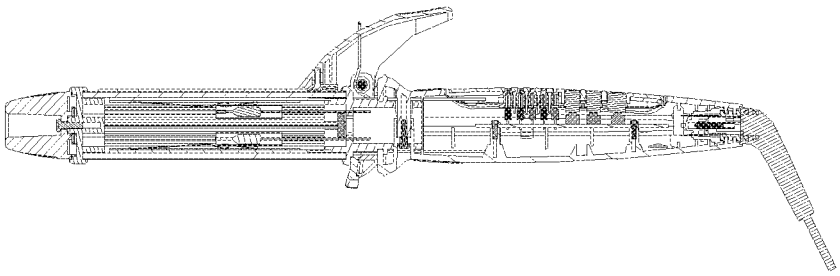
FIG. 6 is a schematic diagram of an internal structure of the present invention.
Figure 7:
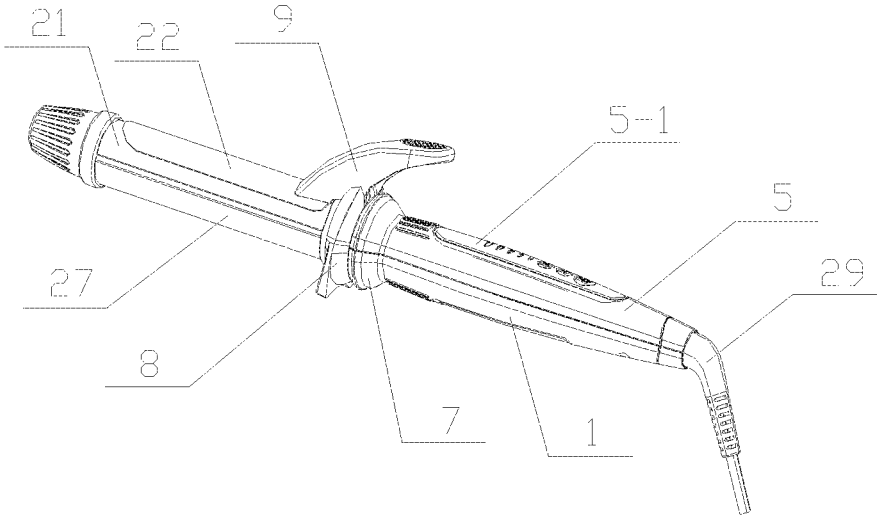
FIG. 7 is a schematic diagram of a three-dimensional structure of the present invention.
Figure 8:
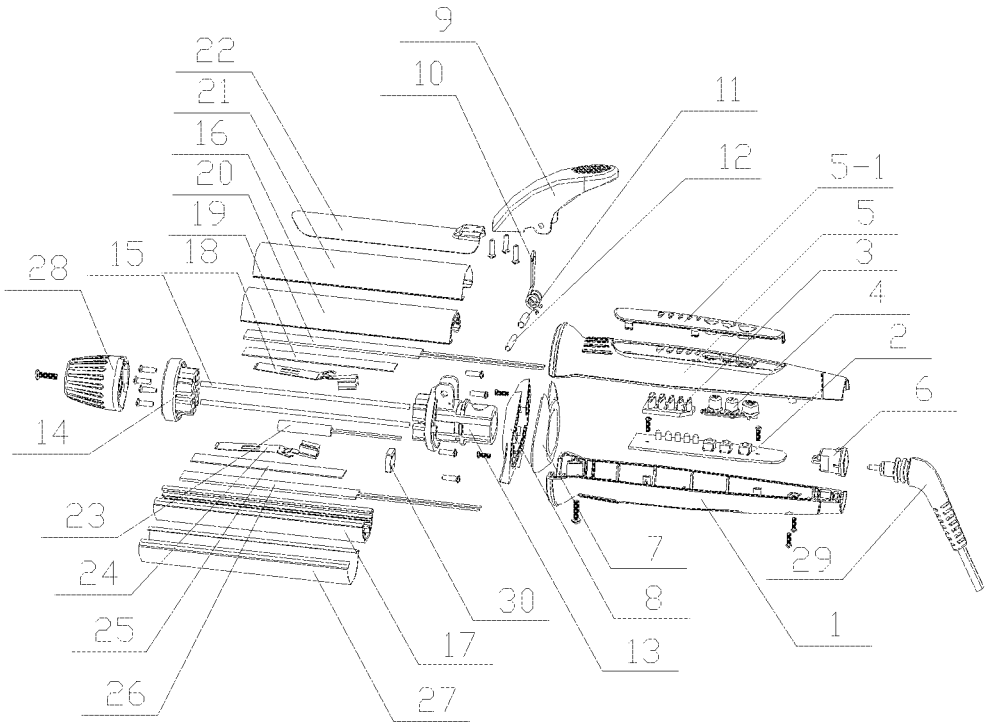
FIG. 8 is a schematic diagram of a breakdown structure of the present invention.

As shown in FIG. 1 to FIG. 8, this specific embodiment adopts the following technical solution: an fabric taped aluminum tubes novel hair curler includes a lower handle 1, a PCBA plate 2, a lamp cover 3, keys 4, an upper handle 5, a turning tail 6, a support cover 7, a support frame 8, a handle key 9, a double-torsion spring 10, a shaft sleeve 11, an iron shaft 12, a connector 13, a front stopper support 14, decorative strips 15, an upper aluminum tube 16, a lower aluminum tube 17, an upper elastic sheet 18, an upper iron sheet 19, a first MCH 20, an upper fabric 21, a clamping sheet 22, a FUSE 23, a lower elastic sheet 24, a lower iron sheet 25, a second MCH 26, a lower fabric 27, a front stopper 28, a power wire 29 and a silica gel stopper 30, wherein the PCBA plate 2 is arranged in the lower handle 1 and fixed in the lower handle 1 via a plurality of screws, the lamp cover 3 and the keys 4 are installed on the PCBA plate 2, the lower handle 1 is fixedly connected with the upper handle 5 via a plurality of screws, the turning tail 6 is screwed into one end of the lower handle, the other end of the lower handle is fixedly connected with the support cover 7, the support cover 7 is fixedly connected with the support frame 8, the handle key 9 is arranged on the support cover, and one side of the lower part of the handle key 9 is fixedly connected with upper parts of the support cover 7 and the support frame 8 via the double-torsion spring 10, the shaft sleeve 11 and the iron shaft 12; one end of the connector 13 is fixedly connected with the support frame 8, a plurality of decorative strips 15 are connected between the other end of the connector 13 and one end of the front stopper support 14, the upper aluminum tube 16 and the lower aluminum tube 17 are arranged between the connector 13 and the front stopper support 14, two ends of the upper aluminum tube 16 and the lower aluminum tube 17 are clamped onto the connector 13 and the front stopper support 14 respectively, and the upper elastic sheet 18, the upper iron sheet 19 and the first MCH 20 are arranged inside the upper aluminum tube 16; the upper fabric 21 is arranged outside the upper aluminum tube 16, the clamping sheet 22 is arranged on the outer surface of the upper fabric 21, one end of the clamping sheet 22 is fixedly connected with the other side of the lower part of the handle key 9 via a plurality of screws, and the FUSE 23, the silicon gel stopper 30, the lower elastic sheet 24, the lower iron sheet 25 and the second MCH 26 are arranged inside the lower aluminum tube 17; the lower fabric 27 is arranged outside the lower aluminum tube 17, the front stopper 28 is fixedly connected with one end of the front stopper support 14 via a plurality of screws, and one end of the power wire 29 is screwed with the turning tail 6.

A decorative part 5-1 is arranged on the upper handle 5; both of the upper aluminum tube 16 and the lower aluminum tube 17 are semicircular or in other shapes manufactured according to the demands of users; and both of the upper fabric 21 and the lower fabric 27 are made of a mixture of silicon gel and polytetrafluoroethylene.

When the fabric taped aluminum tubes novel hair curler is used, a switch button is pressed down, the temperature required for curling hair is selected, the MCH/PTC starts to work, heat is transferred to the upper aluminum tube 16 and the lower aluminum tube 17, and the temperature rises to meet the hair curling requirement. The heater is not limited to the MCH/PTC above, and may also adopt the heating mode of a heating film.

The fabric taped aluminum tubes novel hair curler in the specific embodiment has the advantages that the hair curler is reasonable in structural design, simple in installation and convenient to use; each of the adopted two semicircular aluminum tubes is coated with a fabric, and the fabrics made of a special material can generate negative ions, lock moisture and prevent moisture loss, so that hair can be well protected and is softer; the hair curler has an antistatic function, and its surface is as smooth as silk, so that the hair curler is simple and convenient in operation and more comfortable when the hair curler is in use and meets the use requirements of people.

The basic principle, main features and advantages of the present invention are shown and described above. Those skilled in the art should understand that the present invention is not limited to the above embodiment, what described in the above embodiment and the specification only illustrates the principle of the present invention, various changes and improvements may be made to the present invention without departing from the spirit and scope of the present invention, and these changes and improvements fall into the scope of the present invention. The protection scope of the present invention is defined by the appended claims and equivalents thereof.

The invention claimed is:

1. An fabric taped aluminum tubes novel hair curler, comprising a lower handle (1), a PCBA plate (2), a lamp cover (3), keys (4), an upper handle (5), a turning tail (6), a support cover (7), a support frame (8), a handle key (9), a double-torsion spring (10), a shaft sleeve (11), an iron shaft (12), a connector (13), a front stopper support (14), decorative strips (15), an upper aluminum tube (16), a lower aluminum tube (17), an upper elastic sheet (18), an upper iron sheet (19), a first MCH (20), an upper fabric (21), a clamping sheet (22), a FUSE (23), a lower elastic sheet (24), a lower iron sheet (25), a second MCH (26), a lower fabric (27), a front stopper (28), a power wire (29) and a silica gel stopper (30), wherein the PCBA plate (2) is arranged in the lower handle (1) and fixed in the lower handle (1) via a plurality of screws, the lamp cover (3) and the keys (4) are installed on the PCBA plate (2), the lower handle (1) is fixedly connected with the upper handle (5) via a plurality of screws, the turning tail (6) is screwed into one end of the lower handle, the other end of the lower handle is fixedly connected with the support cover (7), the support cover (7) is fixedly connected with the support frame (8), the handle key (9) is arranged on the support cover (7), and one side of the lower part the handle key (9) is fixedly connected with upper parts of the support cover (7) and the support frame (8) via the double-torsion spring (10), the shaft sleeve (11) and the iron shaft (12); one end of the connector (13) is fixedly connected with the support frame (8), a plurality of decorative strips (15) are connected between the other end of the connector (13) and one end of the front stopper support (14), the upper aluminum tube (16) and the lower aluminum tube (17) are arranged between the connector (13) and the front stopper support (14), two ends of the upper aluminum tube (16) and the lower aluminum tube (17) are clamped onto the connector (13) and the front stopper support (14) respectively, and the upper elastic sheet (18), the upper iron sheet (19) and the first MCH (20) are arranged inside the upper aluminum tube (16); the upper fabric (21) is arranged outside the upper aluminum tube (16), the clamping sheet (22) is arranged on the outer surface of the upper fabric (21), one end of the clamping sheet (22) is fixedly connected with the other side of the lower part of the handle key (9) via a plurality of screws, and the FUSE (23), the silicon gel stopper (30), the lower elastic sheet (24), the lower iron sheet (25) and the second MCH (26) are arranged inside the lower aluminum tube (17); the lower fabric (27) is arranged outside the lower aluminum tube (17), the front stopper (28) is fixedly connected with one end of the front stopper support (14) via a plurality of screws, and one end of the power wire (29) is screwed with the turning tail (6).

2. The fabric taped aluminum tubes novel hair curler of claim 1, wherein a decorative part (5-1) is arranged on the upper handle (5).

3. The fabric taped aluminum tubes novel hair curler of claim 1, wherein both of the upper aluminum tube (16) and the lower aluminum tube (17) are semicircular.

4. The fabric taped aluminum tubes novel hair curler of claim 1, wherein both of the upper fabric (21) and the lower fabric (27) are made of a mixture of silicon gel and polytetrafluoroethylene.

* * * * *